United States Patent [19]

Needham et al.

[11] Patent Number: 4,495,967

[45] Date of Patent: Jan. 29, 1985

[54] FLUID INJECTORS

[75] Inventors: Arthur M. Needham, Surrey; Laurie E. Helyer, Berkshire, both of England

[73] Assignee: Tectron (Eng) Ltd., Surrey, England

[21] Appl. No.: 521,630

[22] Filed: Aug. 9, 1983

[30] Foreign Application Priority Data

Aug. 10, 1982 [GB] United Kingdom ..... 8223010

[51] Int. Cl.[3] ..... F16L 37/28

[52] U.S. Cl. ..... 137/614.06; 251/149.9; 251/367; 285/133 R; 285/137 R; 285/315; 137/625.26

[58] Field of Search ..... 137/614.06, 614.02, 137/614.03, 625.43, 625.5, 625.66, 625.26; 251/149.9, 367; 285/133 R, 137 R, 315

[56] References Cited

U.S. PATENT DOCUMENTS

| | | | |
|---|---|---|---|
| 2,477,669 | 8/1949 | Stephens | 137/625.26 |
| 3,214,195 | 10/1965 | Zahurunec et al. | 285/137 R |
| 3,292,937 | 12/1966 | Nunley | 285/133 R |
| 3,608,582 | 9/1971 | Lambert | 137/614.02 |
| 3,693,655 | 9/1972 | Frisk | 251/149.9 |
| 3,843,172 | 10/1974 | Stevens, Jr. | 285/137 R |
| 3,976,099 | 8/1976 | Russell | 137/614.06 |
| 4,069,842 | 1/1978 | Steydle et al. | 137/614.06 |
| 4,102,356 | 7/1978 | Knight | 137/614.06 |
| 4,285,364 | 8/1981 | Hawker | 137/614.03 |

*Primary Examiner*—A. Michael Chambers

*Attorney, Agent, or Firm*—Schwartz, Jeffery, Schwaab, Mack, Blumenthal & Koch

[57] ABSTRACT

A fluid injector particularly for injecting fluid into a furnace comprises a housing structure having inlet and outlet ports; a pair of fluid connections and means defining passageways for fluid between the ports and respective ones of the fluid connections; and valve means for controlling the flow of fluid along said passageways; a body assembly including an elongate tubular portion having provision for receiving a nozzle at its outer end; a pair of fluid connections and means defining passageways for fluid between each of the fluid connections and said outer end of the tubular portion; said housing structure providing a support for the body assembly and including fluid pressure means for displacing the assembly relative to the housing between a first position, in which the fluid connections on the body assembly are coupled to respective fluid connections on the housing structure, and a second position, in which the fluid connections on the body assembly are disconnected from the fluid connections on the housing structure, and mechanical interlock means arranged to allow said valve means to be operable to permit the flow of fluid along the passageways when the body assembly is in the first position, but not operable when the body assembly is in the second position, and for preventing the body assembly from being moved from the first to the second position when said valve means permit the flow of fluid along the passageways.

13 Claims, 9 Drawing Figures

FLUID INJECTORS

The invention relates to fluid injectors. A particular, but not sole, application of the invention is to injectors for injecting liquid fuel into a furnace.

A known injector for injecting fuel oil into a furnace has an elongate body portion with a nozzle at one end through which the fuel is injected into the furnace. The body portion provides fuel paths to and from the nozzle and the paths lead from an inlet port and an outlet port, respectively.

According to the present invention, a fluid injector comprises a housing structure having inlet and outlet ports; a pair of fluid connections and means defining passageways for fluid between the ports and respective ones of the fluid connections; and valve means for controlling the flow of fluid along said passageways; a body assembly including an elongate tubular portion having provision for receiving a nozzle at its outer end; a pair of fluid connections and means defining passageways for fluid between each of the fluid connections and said outer end of the tubular portion; said housing structure providing a support for the body assembly and including fluid pressure means for displacing the assembly relative to the housing between a first position, in which the fluid connections on the body assembly are coupled to respective fluid conections on the housing structure, and a second position, in which the fluid connections on the body assembly are disconnected from the fluid connections on the housing structure, and mechanical interlock means arranged to allow said valve means to be operable to permit the flow of fluid along the passageways when the body assembly is in the first position, but not operable when the body assembly is in the second position, and for preventing the body assembly from being moved from the first to the second position when said valve means permit the flow of fluid along the passageways.

The invention ensures that the body assembly with the nozzle at one end cannot be moved from its firing position to its non-firing position while the fluid is still being supplied to the nozzle and, furthermore, the valve means for controlling the flow of fluid to and from said ports of the housing cannot be operated unless the body assembly is in the firing position.

Figure 1:
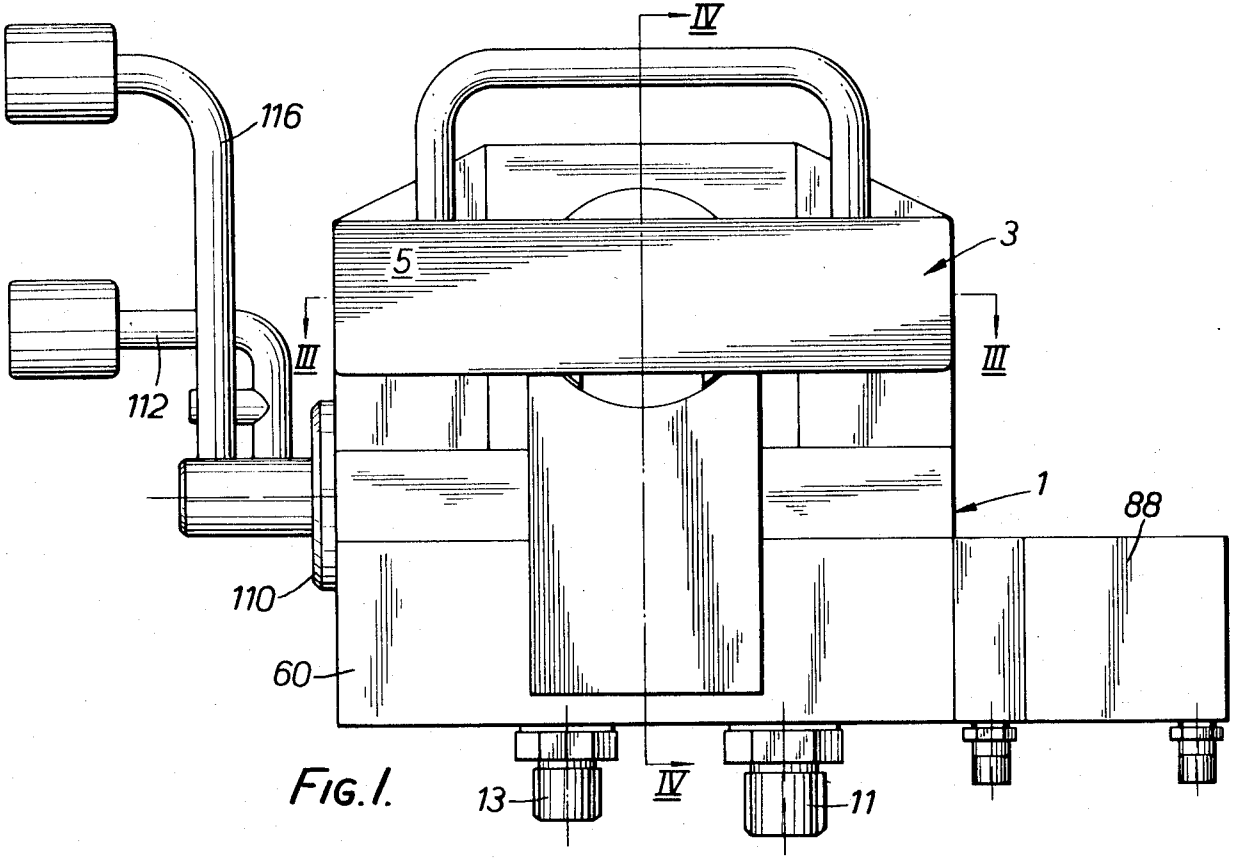
Figure 2:
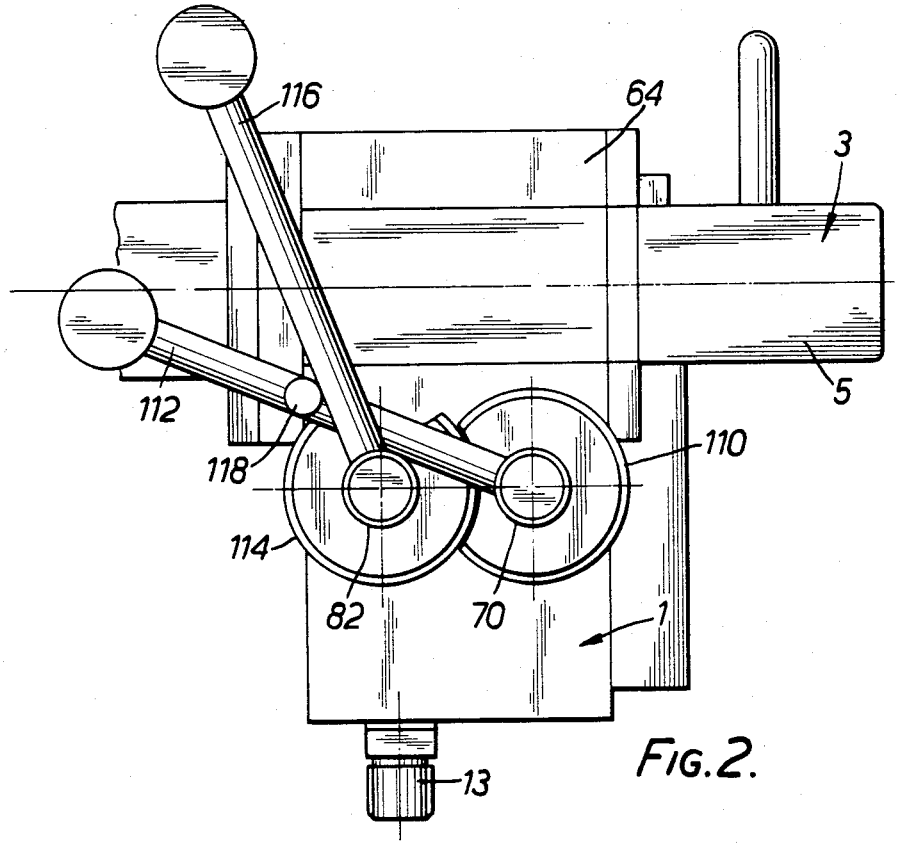
Figure 3:
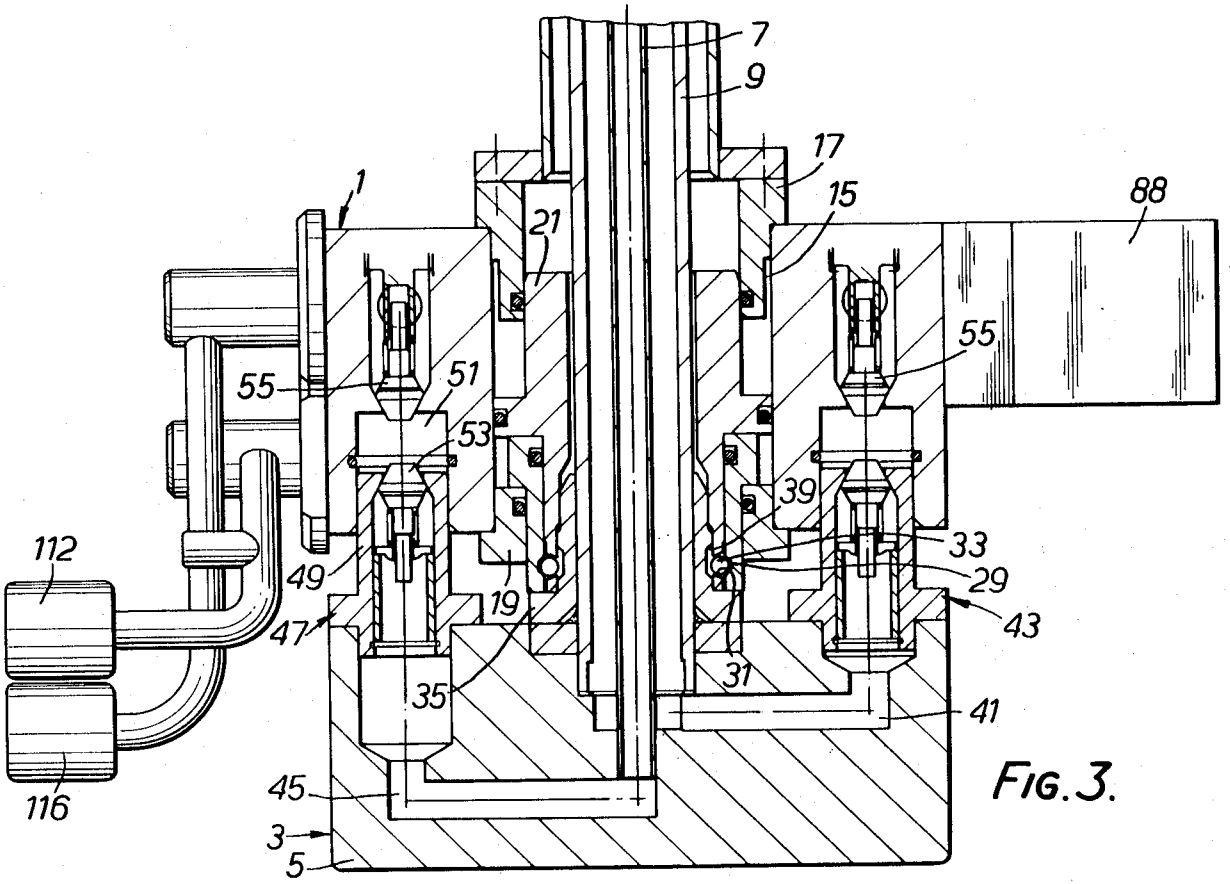
Figure 4:
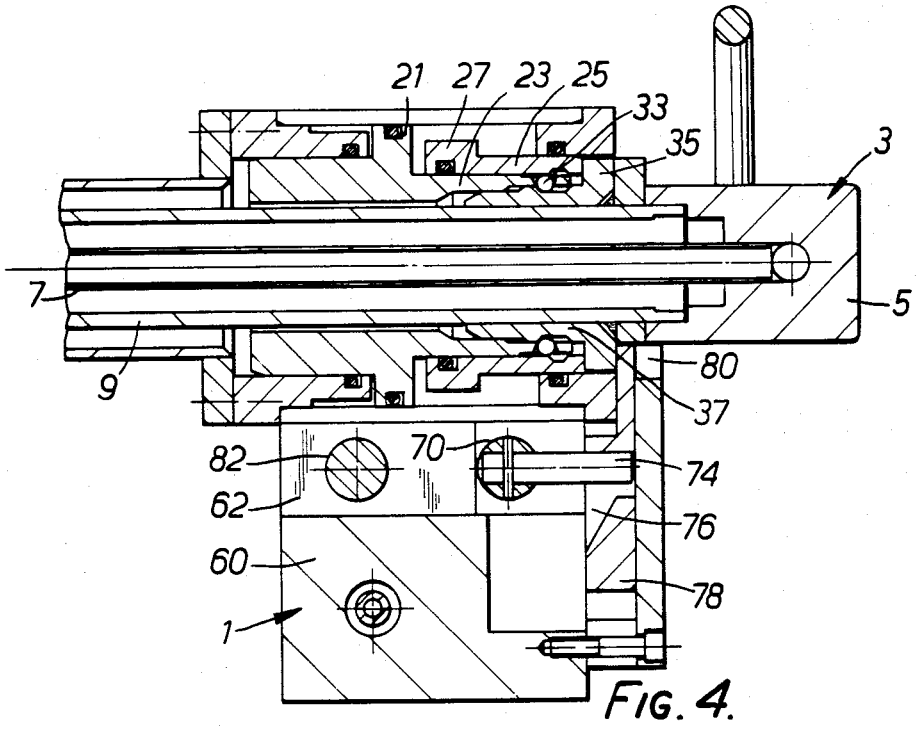
Figure 5:
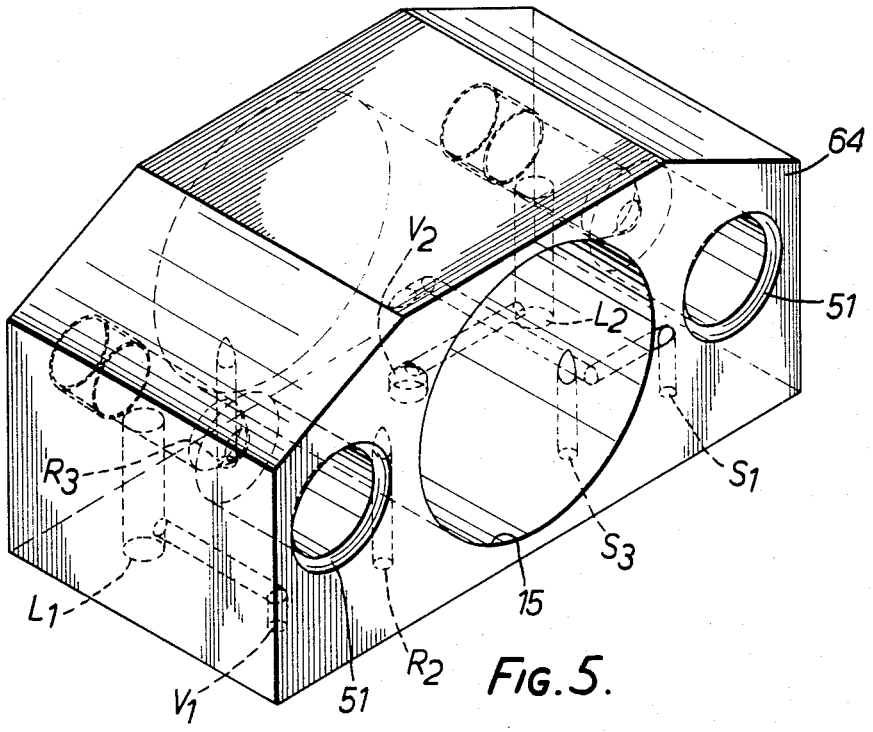
Figure 6:
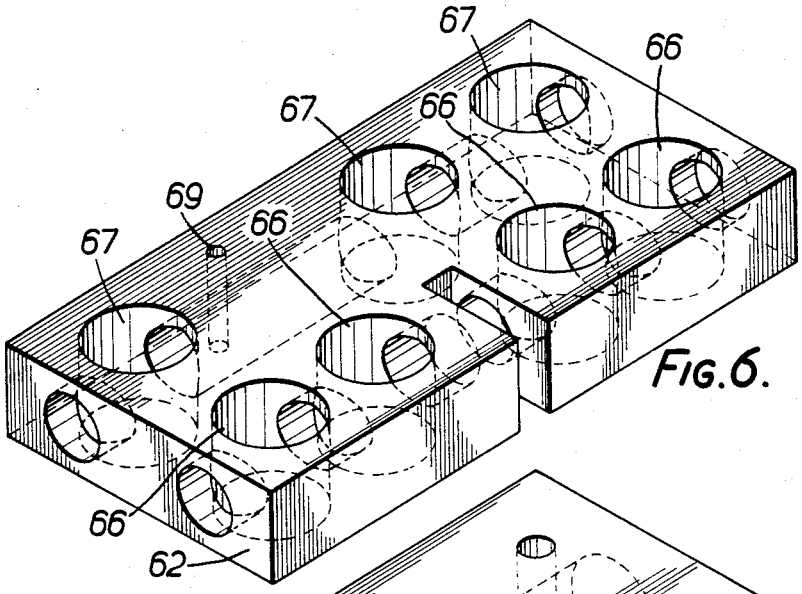
Figure 7:
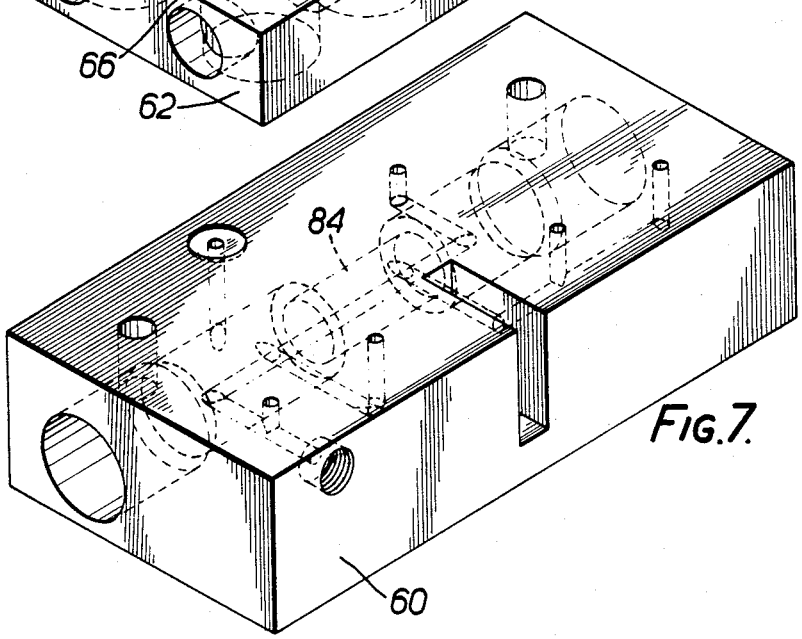
Figure 8:
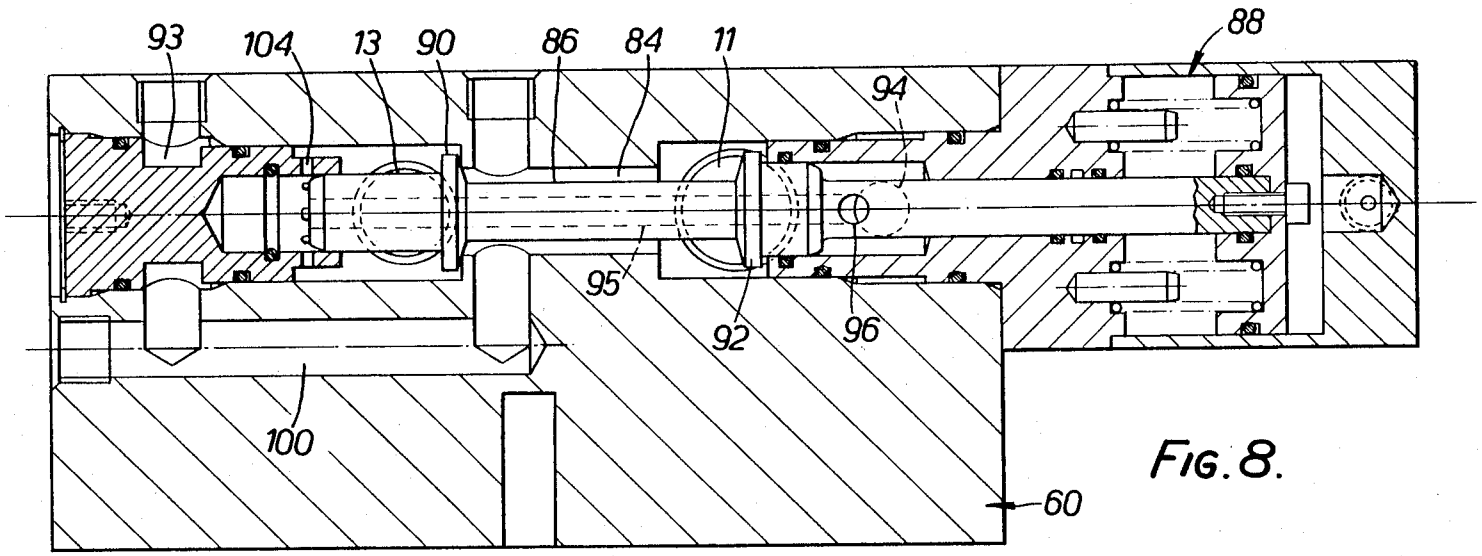
Figure 9:
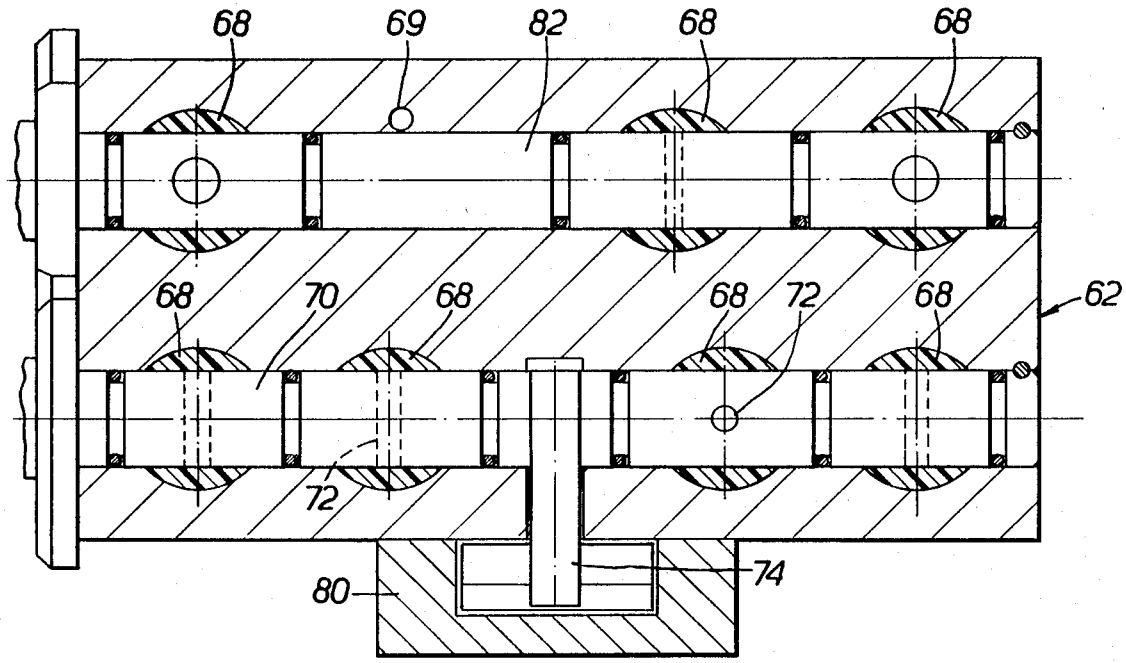

In order that the invention may be more readily understood, it will now be described, by way of example only, with the reference to the accompanying drawings, in which:

FIG. 1 is a front elevation of an injector for injecting fuel oil to a furnace, FIG. 2 is a side elevation of the injector, FIG. 3 is a section on the line III—III of FIG. 1 with the injector in a non-firing position, FIG. 4 is a section on the line IV—IV of FIG. 1 with the injector in a firing position, FIG. 5 is a perspective view of the head of the housing structure of the injector, FIGS. 6 and 7 are perspective views of the valve plate and the changeover valve block, respectively, FIG. 8 is a section through the changeover valve block with the valve member fitted, and FIG. 9 is a section through the valve plate with the valve bodies and operating shafts fitted.

An injector for injecting fuel oil to a furnace consists of a housing structure, generally indicated by reference numeral 1, which is normally arranged stationary, and a body assembly 3, which is movable relative to the housing structure. The body assembly 3 includes a generally rectangular block 5 having a pair of tubes 7, 9 extending from it. The tube 7 is coaxially within the tube 9 and these tubes serve to provide passages between the block and a nozzle (not shown) which is positioned at the ends of the tubes which are away from the block. The nozzle is of a well known construction and is arranged such that, with liquid flow in one direction, differential pressure between parts of a valve associated with the nozzle opens the nozzle to discharge liquid from it, and, with liquid flow in the other direction, the nozzle is closed so that the liquid circulates close to the nozzle in order to cool it but without being discharged from it. Such a nozzle is disclosed in British Pat. No. 1426060.

The housing structure includes inlet and outlet ports 11, 13 for the fuel oil and valve means by which the flow of fuel oil to the nozzle can be controlled and also by which the body assembly can be displaced relative to the housing structure.

The upper part or head of the housing structure 1 defines a central opening 15 through which part of the body assembly extends. The opening 15 has a rear cap 17 and a front cover 19, both of which are secured to the housing and together define a cylinder within which a piston 21 is displaceable. The piston has a sleeve portion 23 which is surrounded by a sleeve portion 25 of a second piston 27 which has an enlarged head of smaller diameter than the head portion of the piston 21, and which does not bear against the side wall of the opening 15. A circumferential groove 29 is provided in the inner wall of the sleeve portion 25 and openings 31 are located in the sleeve portion 23 adjacent the groove 29. Balls 33 are located, one in each of the openings 31 so that they form a connection between the two sleeve portions. When each ball is located in the groove 29, it lies entirely within the corresponding opening 31 but, if there is relative axial movement between the two sleeve portions, then each ball rides up one edge of the groove 29 and protrudes from the opening 31. The block 5 carries a ring 35 which includes a sleeve 37 which projects inside the sleeve portion 23 and is provided with a groove 39 closely positioned to the openings 31. When the balls 33 are in ambush in the openings 31, they do not contact the sleeve 37 but, when there is relative movement between the sleeves 23, 25 causing the balls to project out of the opening portions, then they extend into the groove 39 on the sleeve 37. Movement of the sleeve portions 23, 25 in the direction of their length, after there has been relative movement between them, causes the projecting balls to engage with the side walls of the groove 39 and to move the ring 35 and the block 5 with them.

The tube 9 fits firmly within the sleeve 37 of the ring and its end is connected via a fluid passage 41 to a fluid coupling 43 mounted on the block. Similarly, the tube 7 is secured to the block 5 and, by way of a duct 45, it is connected to a further fluid coupling 47. Each coupling has a hollow cylindrical portion 49 which projects rearwardly of the block 5 and is adapted to enter into a cylindrical opening 51 provided in the head of the housing structure 1. Each fluid coupling includes a spring-loaded valve member 53 and, when the body assembly is fully fitted in the housing structure 1, then the valve members 53 on the body assembly engage with similar valve members 55 on the housing structure and the valve members abut each other and cause each of the members to be open to provide a fluid path between them.

Movement of the body assembly into and out of the head of the housing structure is brought about by the pressure of the fuel oil which is supplied to the injector. When oil under pressure is introduced into the part of the cylinder which lies between the piston 21 and the rear cover 19, the piston 21 moves forwardly relative to the piston 27 causing the balls 33 to ride up out of their ambush position. After a small amount of relative movement, the piston 27 is moved with the piston 21 and the balls 33 project from the openings in which they are contained and, as they engage against the wall of the groove 39 in the ring 35, the balls lock against the wall of the and the ring 35 and the block 5 to move with the pistons. This movement continues until the piston is almost at the end of the cylinder, at which time the cylindrical portions 49 on the block 5 have moved sufficiently far into the openings 51 in the housing for the end faces of the valve members to abut and the valve members to open the respective passages so that the fluid paths between the head of the housing structure and the body assembly are in communication.

Reverse movement of the body assembly is obtained by applying oil under pressure into the part of the cylinder between the cover 17 and the enlarged head of the piston 21 causing the piston 21 and the sleeve 23 to be displaced axially forwards to abut against the ring 35 causing the block 5 of the body assembly 3 to be moved out of engagement with the housing. During this movement, the valve members on the fluid couplings are separated, thus allowing each valve member to seal its respective passage, thus closing the fluid paths. In this condition, the balls 33 are free to move outwardly into ambush, allowing the body assembly 3 complete with the tubes 7, 9 to be manually removed from the housing structure.

It is most essential that the body assembly is in its correct operating postion relative to the housing structure before any attempt is made to supply fuel oil to the nozzle positioned at the ends of the tubes 7, 9. Furthermore, when fuel oil is being supplied to the nozzle, it is most essential that the body assembly cannot be moved away from the housing structure. To this end, there are a series of interlocks on the injector which ensure correct operation.

The distribution of the liquid within the housing structure will now be described. The housing structure 1 consists basically of three parts, namely, a changeover valve block 60 positioned beneath a valve plate 62 which, in turn, is positioned beneath a head 64. There are a plurality of passages extending from one of these parts of the housing structure to another and, when the head valve plate and valve block are secured together by means of bolts (not shown), the passages are connected together without loss of liquid at the joints between the various parts.

Referring to FIG. 5, the head 64 is shown with the opening 15 therethrough and the cylindrical openings 51 are on opposite sides of the opening 15. There are a plurality of ducts formed in the head 64. The ducts extend to eight openings formed in the under surface of the head. These openings are arranged generally in two rows. In the row nearest to the front of the head, there are four openings, referred to from left to right of FIG. 5 as follows: $V_1$; $R_2$; $S_3$; and $S_1$. In the second row towards the back of the head, there are three openings referred to as follows: $L_1$; $V_2$; and $L_2$. Behind the second row, there is a single opening referred to as $R_3$. Ducts extending from the openings $R_2$, $S_1$, $S_3$ and $R_3$ lead to the opening 15, ducts from the openings $L_1$ and $V_1$ lead to one of the openings 51 and ducts from the openings $L_2$ and $V_2$ extend to the other opening 51.

As can be seen from FIGS. 6 and 9, the valve plate immediately below the head has eight openings in it, the openings being positioned beneath the eight openings in the lower surface of the head 64. Four openings 66 are arranged in a row at the front of the plate 62 and each one contains a cylindrical body 68 of resilient sealing material, for example glass filled PTFE, which is a tight fit in the opening. Each body has a first opening through it extending in the direction between the top and the bottom of the plate 62 and a further opening in it extending in the direction of the row in which the openings are formed. A shaft 70 extends through the openings in the direction of the row and the shaft is free to rotate with respect to the cylindrical bodies. The shaft has holes 72 drilled through it and, for each of the bodies, there is an angular position of the shaft in which the hole in the body which extends between the top and the bottom thereof is aligned with a separate one of the holes in the shaft. When the holes extend from the top to the bottom of the plate, the holes are in alignment with respective ones of the openings $V_1$, $R_2$, $S_3$ and $S_1$ on the underside of the head. The shaft 70 carries a finger 74 which projects into a slot 76 formed in a latch 78 which is slidable vertically in a channel 80 formed on the housing. The upper end of the latch is positioned forwardly of the ring 35 formed on the assembly 3. When the latch is in its uppermost position, the ring cannot be withdrawn from the opening 15. On rotating the shaft 70, the finger can lower the latch to thereby allow the ring to be withdrawn from the opening.

Three openings 67 which form a second row in the plate 62 each have a cylindrical PTFE body 68 in it and a further shaft 82 projects through openings in the PTFE bodies. The shaft has holes through it and, on rotating the shaft, the holes in the shaft can be brought in turn into alignment with the holes through the PTFE bodies in order to provide a passage between the upper and lower surfaces of the plate.

The eighth opening 69 is on its own and does not have a valve in it.

Referring to FIGS. 7 and 8, the changeover valve block 60 has the inlet and outlet ports 11, 13 positioned on its underside. These ports lead to a duct 84 extending from end to end of the plate and an elongate valve member 86 is displaceable in the direction of its length by means of a fluid operated piston-cylinder device 88 mounted on one side of the valve plate and connected to the valve member. The piston-cylinder device 88 can be double-acting or single-acting with springs to provide the return motion. The valve member 86 carries two enlarged valves 90, 92 which engage respective valve seats. On the upper surface of the valve block, there are eight openings which correspond to the eight openings in the lower surface of the valve plate 62. The lower end of the opening $L_1$ leads to an annular slot 93 formed in a plug at one end of the valve member and the opening corresponding to the opening $L_2$ leads to a recess 94 in a plug at the opposite end of the valve member. The valve member has an axial hole 95 formed in it, the hole extending to one end of the valve member and communicating with radial holes 96 at the other end of the valve member. In the arrangement shown in the figure with the piston-cylinder device 88 not energised, liquid entering the inlet 11 flows around the valve member, along an internal duct 100 and into the annular groove 93 formed in the plug. From this groove, the fluid flows upwardly and out of the valve block into the $L_1$ duct in the valve plate and the head. The return liquid flows down the $L_2$ duct into the hole 96 and into the axial hole 95 in the valve member. After flowing out of the free end of the valve member, the liquid passes through a radial opening 104 in the end plug and out of the injector through the outlet 13.

When the piston-cylinder device 88 is energised, thereby causing the valve member to be displaced to the left, as shown in the figure, liquid entering through the inlet port 11 is prevented from entering the duct 100 by the valve 92 but can flow into the $L_2$ duct from where it flows to the nozzle. Liquid returning from the nozzle descends down the $L_1$ duct into the annular groove 93 and along the internal duct 100, through the valve 90 into the outlet port 13. Thus, the valve member 86 serves as a changeover valve for reversing the direction of flow of liquid to and from the nozzle by way of the tubes 7, 9.

In one direction of flow, the nozzle is caused to open to discharge the oil but, in the other direction of flow, the nozzle remains closed and the oil serves to cool the nozzle.

Referring again to FIGS. 1, 2 and 3, it can be seen that shaft 70 carries a cam 110 outside the housing and an operating handle 112 is attached to the shaft. In a similar manner, shaft 82 carries a cam 114 outside the housing and an operating handle 116 is attached to the shaft. The two cams are of cylindrical form and each has part of its periphery cut away.

In the clamped position shown in FIG. 2, the handle 116, which controls the flow of oil to and from the nozzle, cannot be rotated in an anti-clockwise direction because it abuts against a stop 118 on the handle 112, and the handle 112 cannot be rotated in an anti-clockwise direction because it abuts against the shaft. In this clamped position, fuel oil is flowing to and from the nozzle along the tubes 7, 9 and the body assembly is held firmly in its first position in which connection is made between the respective fluid couplings 53, 55. The handle 112 is interlocked and cannot be moved to a position in which the body assembly is withdrawn from the housing structure.

When it is necessary to withdraw the body assembly, the handle 116 is rotated clockwise through 90° and the cams 110, 114 permit this movement to take place. This movement of the handle rotates the shaft 82 so that the openings in the valve plate 62 corresponding to $L_1$ and $L_2$ ducts are closed, thus cutting off the supply to the nozzle. The openings 51 are vented through the passage $V_2$.

The handle 112 can then be rotated through 90° in a clockwise direction, since the cams 114, 110 permit this movement. This movement rotates the shaft 70 and causes the oil pressure to be applied into the opening 15 on the side of the piston 21 which is away from the block 5, thus causing the body assembly to be displaced to its second position where the connections between the fluid couplings 53, 55 are broken. A restrictor (not shown) is provided in the head in the duct leading to opening $R_3$ and this restrictor prevents a rapid flow of oil and the body assembly is withdrawn in an orderly manner. This movement of the shaft 70 also causes opening 51 to be vented through passage $V_1$.

It will be appreciated that rotation of the handle 112 in a clockwise direction rotates the shaft 70 and the finger 74 and thus lowers the latch 78. This permits the body assembly to be withdrawn.

In the second position of the body assembly, i.e. where the fluid couplings are disconnected, the cams 114, 110 prevent the handle 116 from being rotated in order to reconnect the supply to the nozzle.

In the event of the body assembly 3 not being fully inserted, or in the complete absence of body assembly 3, handle 112 can only be moved through the first 60° of movement because latch 78 will abut sleeve portion 25. In either of these conditions, the absence of ring 35 with the sleeve portion 23 allows sleeve portion 23 to move forwardly under the influence of fluid pressure in the cylinder acting on the piston 21, moving sleeve portion 23, causing balls 33 to be displaced inwardly by the walls of groove 39 in the sleeve portion 25, allowing sleeve portion 23 to be displaced forwardly independently of sleeve portion 25. Sleeve portion 25, not being moved by the abutment of ring 35, is held in its fully extended position by the fluid pressure acting on the annular area defined by the sleeve portion 23 and tne end cap 17, thus preventing latch 78 and handle 112 completing their movement. In this condition, handle 116 cannot be moved due to the engagement of the cams, thus preventing any fluid flow to the nozzle ensuring that the complete assembly is in a safe mode.

In the description the displacement of the body assembly has been brought about by pressure of the liquid which is supplied to the ports 11, 13. If the ducts in the housing structure were arranged differently and connected to separate fluid ports, then displacement of the body assembly could be brought about by the action of a separate fluid supplied to these ports.

We claim:

1. A fluid injector comprising a housing structure having inlet and outlet ports;

a pair of fluid connections and means defining passageways for fluid between the ports and respective ones of the fluid connections; and valve means for controlling the flow of fluid along said passageways;

a body assembly including an elongate tubular portion having provision for receiving a nozzle at its outer end;

a pair of fluid connections and means defining passageways for fluid between each of the fluid connections and said outer end of the tubular portion;

said housing structure providing a support for the body assembly and including fluid pressure means for displacing the assembly relative to the housing between a first position, in which the fluid connections on the body assembly are coupled to respective fluid conections on the housing structure, and a second position, in which the fluid connections on the body assembly are disconnected from the fluid connections on the housing structure, and mechanical interlock means arranged to allow said valve means to be operable to permit the flow of fluid along the passageways when the body assembly is in the first position, but not operable when the body assembly is in the second position, and for preventing the body assembly from being moved from the first to the second position when said valve means permit the flow of fluid along the passageways.

2. A fluid injector as claimed in claim 1, in which the fluid connections on the housing structure and those on the body assembly each comprise a valve having a spring loaded normally closed valve member and, in the first position of the assembly, the valve members on the body assembly abut against those on the housing structure to open the valves.

3. A fluid injector as claimed in claim 1 or 2, wherein the tubular portion of the body assembly is connectible to said fluid pressure means in the form of a piston assembly displaceable in a cylinder defined by the housing structure and, when so connected, movement of the piston assembly serves to displace the body assembly between said first and second positions.

4. A fluid injector as claimed in claim 1, wherein the tubular portion of the body assembly is connectible to said fluid pressure means in the form of a piston assembly displaceable in a cylinder defined by the housing structure and, when so connected, movement of the piston assembly serves to discplace the body assembly between said first and second positions.

5. A fluid injector as claimed in claim 4, wherein said piston assembly includes a plurality of balls which are movable between an ambush position and a non-ambush position and, in the ambush position, the balls engage with the body assembly to form a connection therewith.

6. A fluid injector as claimed in claim 4, in which said fluid pressure means for displacing the assembly are operable by fluid supplied to the inlet port.

7. A fluid injector as claimed in claim 1, in which said fluid pressure means for displacing the assembly are operable by fluid supplied to the inlet port.

8. A fluid injector as claimed in claim 7, in which said fluid pressure means includes valve means mounted on a shaft having a portion projecting from the housing structure, and a handle on the projecting portion of the shaft.

9. A fluid injector as claimed in claim 8, including a finger mounted on said shaft, said finger being engageable with a mechanical latch displaceable into a position where it prevents the body assembly being displaced between its first and its second positions, said finger causing the latch to be displaced into said position when the shaft is in the position corresponding to the first position of the body assembly and said latch preventing the shaft from being moved to the position corresponding to the first position of the body assembly when the body assembly is not positioned in or correctly positioned in the housing structure.

10. A fluid injector as claimed in claim 7, in which said valve means for controlling the flow of fluid along said passageways includes a shaft having a portion projecting from the housing structure and a handle on the projecting portion of the shaft.

11. A fluid injector as claimed in claim 10, in which each of said shafts has a cam thereon, said cams being arranged to prevent the valve means associated with the fluid pressure means from being actuated by the handle to displace the body assembly from its first position to the second position when the valve means for controlling the flow of fluid along the passageways is in the position to permit such fluid flow, said cams also being arranged to prevent the valve means for controlling the flow of fluid along the passageways from being actuated by said handle to permit such fluid flow when the body assembly is in its second position.

12. A fluid injector as claimed in claim 11, wherein each cam is of cylindrical form with a portion of its peripheral edge omitted.

13. A fluid injector as claimed in claim 1, in which said fluid pressure means for displacing the assembly are operable by fluid other than the fluid supplied to the inlet port.

* * * * *